US006190008B1

(12) United States Patent
Iwashita et al.

(10) Patent No.: US 6,190,008 B1
(45) Date of Patent: Feb. 20, 2001

(54) BUBBLE REMOVER FOR INKJET HEAD AND METHOD FOR REMOVING BUBBLES THEREOF

(75) Inventors: Yoshitaka Iwashita; Susumu Tokumaru; Hiroshi Fukumoto; Hirohumi Matsuo, all of Tokyo (JP)

(73) Assignee: Mitsubishi Denki Kabushiki Kaisha, Tokyo (JP)

( * ) Notice: Under 35 U.S.C. 154(b), the term of this patent shall be extended for 0 days.

(21) Appl. No.: 09/265,424

(22) Filed: Mar. 10, 1999

(30) Foreign Application Priority Data

Jul. 14, 1998 (JP) ..... 10-198869

(51) Int. Cl.[7] ..... B41J 2/19
(52) U.S. Cl. ..... 347/92
(58) Field of Search ..... 347/85, 86, 87, 347/89, 92, 29, 30

(56) References Cited

U.S. PATENT DOCUMENTS 5,757,399 * 5/1998 Murayama et al. ..... 347/32

FOREIGN PATENT DOCUMENTS

803362 * 10/1997 (EP) .
4-1055 1/1992 (JP) .
5-220970 8/1993 (JP) .
6-55742 3/1994 (JP) .

* cited by examiner

*Primary Examiner*—N. Le
*Assistant Examiner*—Michael Nghiem
(74) *Attorney, Agent, or Firm*—Sughrue, Mion, Zinn, Macpeak & Seas, PLLC

(57) ABSTRACT

When bubbles affecting the performance of spitting ink are generated in an ink reservoir, the bubbles are completely removed to attain a state full of ink without bubbles of the ink reservoir. An inkjet head comprising an ink tank, an ink reservoir having a nozzle array, and an ink supply path for introducing ink from the ink tank into the ink reservoir is characterized in that, with the ink supply path being closed and with a vent hole for making the ink reservoir in communication with the external being open, an ink suction device introduces the outside air via the vent hole into the ink reservoir to which negative pressure is applied by the suction of ink, while ink in the ink reservoir is sucked out to the external via a suction path.

6 Claims, 7 Drawing Sheets

BUBBLE REMOVER FOR INKJET HEAD AND METHOD FOR REMOVING BUBBLES THEREOF

BACKGROUND OF THE INVENTION

1. Field of the invention

The present invention relates to an inkjet head, and more particularly, to a bubble remover for an inkjet head comprising an ink tank, an ink reservoir having a nozzle array, and an ink supply path for introducing ink from the ink tank to the ink reservoir, and a method for removing bubbles thereof.

2. Description of the Related Art

FIG. 7 is a sectional view illustrating a conventional inkjet head and a maintenance mechanism disclosed in, for example, Japanese Patent Laid-open Application No. Hei 5-220970.

First, the inkjet head is described. Numerals 1, 2, and 7 of the figure denote a nozzle array where a plurality of nozzles are provided, an opening for directly sucking ink from an ink reservoir 3, and an ink cartridge as an ink tank, respectively. The ink reservoir 3 has the nozzle array 1 formed of the plurality of nozzles, and is normally filled with ink supplied from the ink tank 7. A numeral 4 denotes an ink supply path for introducing ink from the ink tank 7 to the ink reservoir 3.

Next, the maintenance mechanism is described. A cap portion 8 is detachably attached to the distal end side of the nozzles of the nozzle array 1, and sucks ink via the nozzles from the ink reservoir 3. A numeral 9 denotes a second cap portion for sucking ink via the opening 2 from the ink reservoir 3. Numerals 15 and 16 are solenoid valves for opening and closing suction paths extendedly provided from the first and second cap portions 8 and 9, respectively. A numeral 17 denotes a suction pump for sucking ink via the suction paths from the first and second cap portions 8 and 9.

A conventional inkjet head and a conventional maintenance mechanism are constructed as mentioned in the above. Ink suction ordinarily conducted for maintenance (hereinafter referred to as ordinary ink suction) is carried out by, after closing the solenoid valve 16 leading to the second cap portion 9 and opening the solenoid valve 15 leading to the first cap portion 8, actuating the suction pump 17 to suck ink via the nozzles from the ink reservoir 3, thereby discharging bubbles 19 inside the ink reservoir 3, particularly those generated in the vicinity of the region where the nozzle array 1 is provided on the base side, to the side of the first cap portion 8 together with the sucked ink.

However, the bubbles 19 in the ink reservoir 3 which can not be removed by the ordinary ink suction in the construction mentioned in the above are dealt with by special ink suction described in the following.

First, the solenoid valve 15 leading to the first cap portion 8 is closed, and the solenoid valve 16 leading to the second cap portion 9 is opened. Then, the suction pump 17 is actuated to directly suck ink in the ink reservoir 3 not via the nozzles but through the suction path via the opening 2 and the solenoid valve 16. This special ink suction makes ink in the ink tank 7 continue to flow from the ink supply path 4 through the ink reservoir 3 into the opening 2 during the suction continues. The bubbles 19 in the vicinity of the region where the nozzle array 1 is provided, which is a connecting portion between the ink reservoir 3 and the nozzles, are washed away by the continuous ink flow toward the opening 2, and, eventually, the bubbles 19 are taken out on the side of the second cap portion 9 via the opening 2.

With the conventional construction mentioned in the above, since the special ink suction, which is sucking operation not via the nozzles but from the opening 2 provided on the side of one end of the ink reservoir 3, can be conducted other than the ordinary ink suction for maintenance which is sucking operation via the nozzles, two kinds of ink flows can be generated in the ink reservoir 3. The bubbles 19 generated in or moved into the regions of the ink flows can be washed away by the ink flows.

However, the bubbles 19 generated in or moved into a region out of the two kinds of ink flows mentioned in the above, particularly relatively fine bubbles 19 generated in and attached to the vicinity of the region where the nozzle array 1 is provided on the base side, have strong adhesion. There was a problem that, since it is difficult for the conventional ink flows to wash such bubbles away or separate them from the place where they adhere and they are difficult to float in the ink flows, they can not be easily removed.

Further, since the conventional method requires continuous ink flow in order to remove the bubbles 19, there is a problem of diseconomy, i.e., waste of ink.

SUMMARY OF THE INVENTION

The present invention is made to solve the above problems, and an object of the present invention is to provide a bubble remover for an inkjet head capable of, without wasting ink, removing bubbles which can not be removed by a conventional ink flow (suction), and a method for removing bubbles thereof.

According to one aspect of the present invention, an inkjet head comprising an ink tank, an ink reservoir having a nozzle array, and an ink supply path for introducing ink from the ink tank into the ink reservoir is characterized by further comprising a supply control valve for opening and closing the ink supply path, a vent hole provided with a vent control valve for making the ink reservoir in communication with the external, an ink suction means for sucking ink from the ink reservoir, and a suction control means for making the ink suction means suck ink from the ink reservoir with the supply control valve closed and with the vent control valve open.

According to another aspect of the present invention, a method for removing bubbles of an inkjet head comprising an ink tank, an ink reservoir having a nozzle array, and an ink supply path for introducing ink from the ink tank into the ink reservoir is characterized in that ink is sucked from the ink reservoir as the outside air is introduced by an ink suction means into the ink reservoir via a vent hall for making the ink reservoir in communication with the external, negative pressure being applied to the ink reservoir by the suction of ink, with the ink supply path closed and with the vent hall open.

According to still another aspect of the present invention, an inkjet head comprises an ink tank, an ink reservoir having a nozzle array, and an ink supply path for introducing ink from the ink tank into the ink reservoir is characterized by further comprising a tilt means for tilting the inkjet head such that ink filling the ink reservoir flows back toward the ink supply path to retreat at least from the region where the nozzle array is provided in the ink reservoir and a vent hall provided with a vent control valve for making the ink reservoir in communication with the external such that the retreat of ink is facilitated.

BRIEF DESCRIPTION OF THE DRAWINGS

These and other objects, features and advantages of this invention will become more fully apparent from the following detailed description taken with the accompanying drawings in which.

DETAILED DESCRIPTION OF THE PREFERRED EMBODIMENTS

Embodiment 1

This Embodiment 1 is an embodiment of claims 1 and 2 of the present invention, in which an inkjet head comprises an ink tank, an ink reservoir having a nozzle array, and an ink supply path for introducing ink from the ink tank into the ink reservoir, further comprises a supply control valve for opening and closing the ink supply path, a vent hole provided with a vent control valve for making the ink reservoir in communication with the external, an ink suction means for sucking ink from the ink reservoir, and a suction control means for making the ink suction means suck ink from the ink reservoir with the supply control valve closed and with the vent control valve open.

Embodiment 1 is now described in the following with reference to the drawings.

Figure 1:
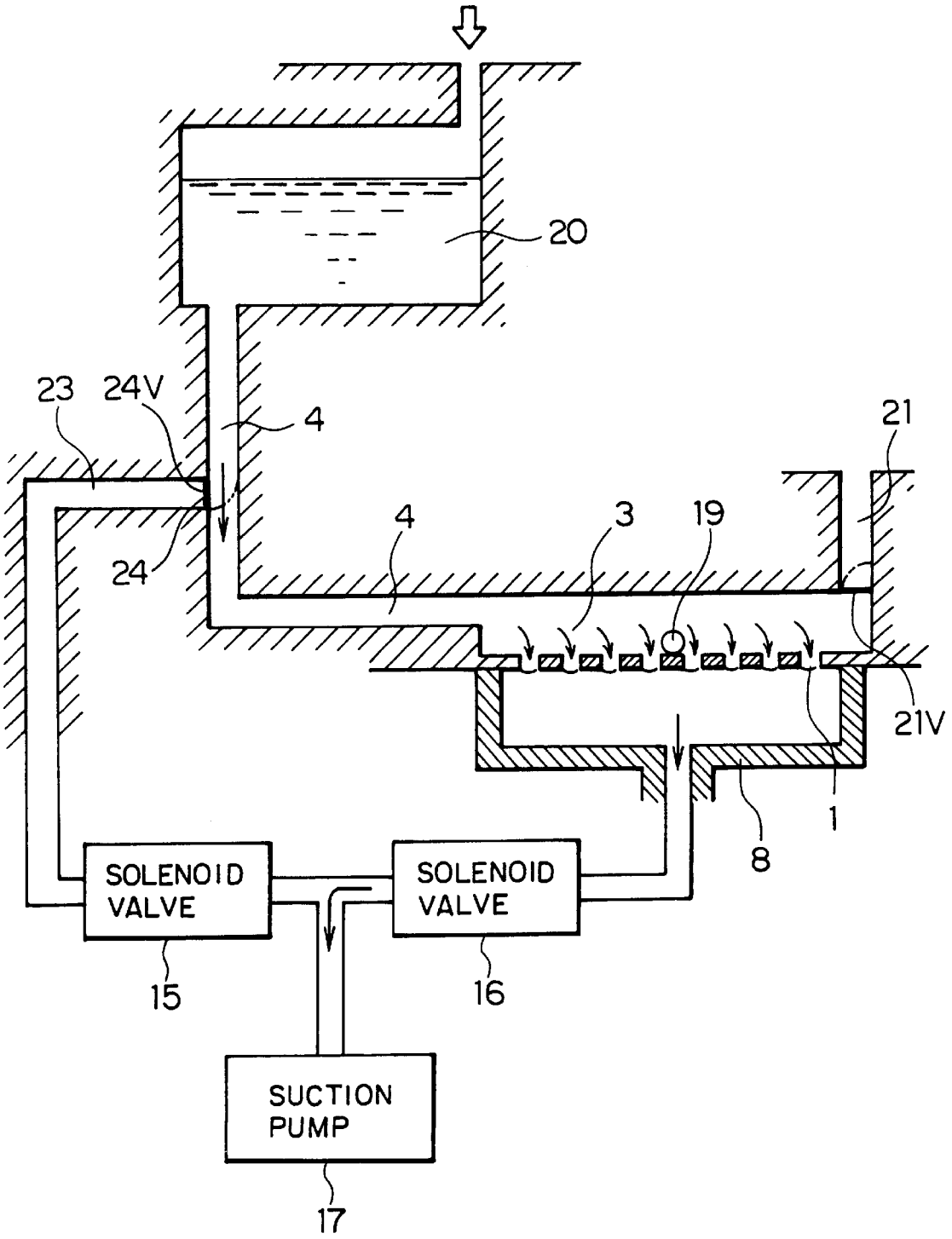
FIG. 1 is a sectional view illustrating Embodiment 1 of the present invention.
Figure 2:
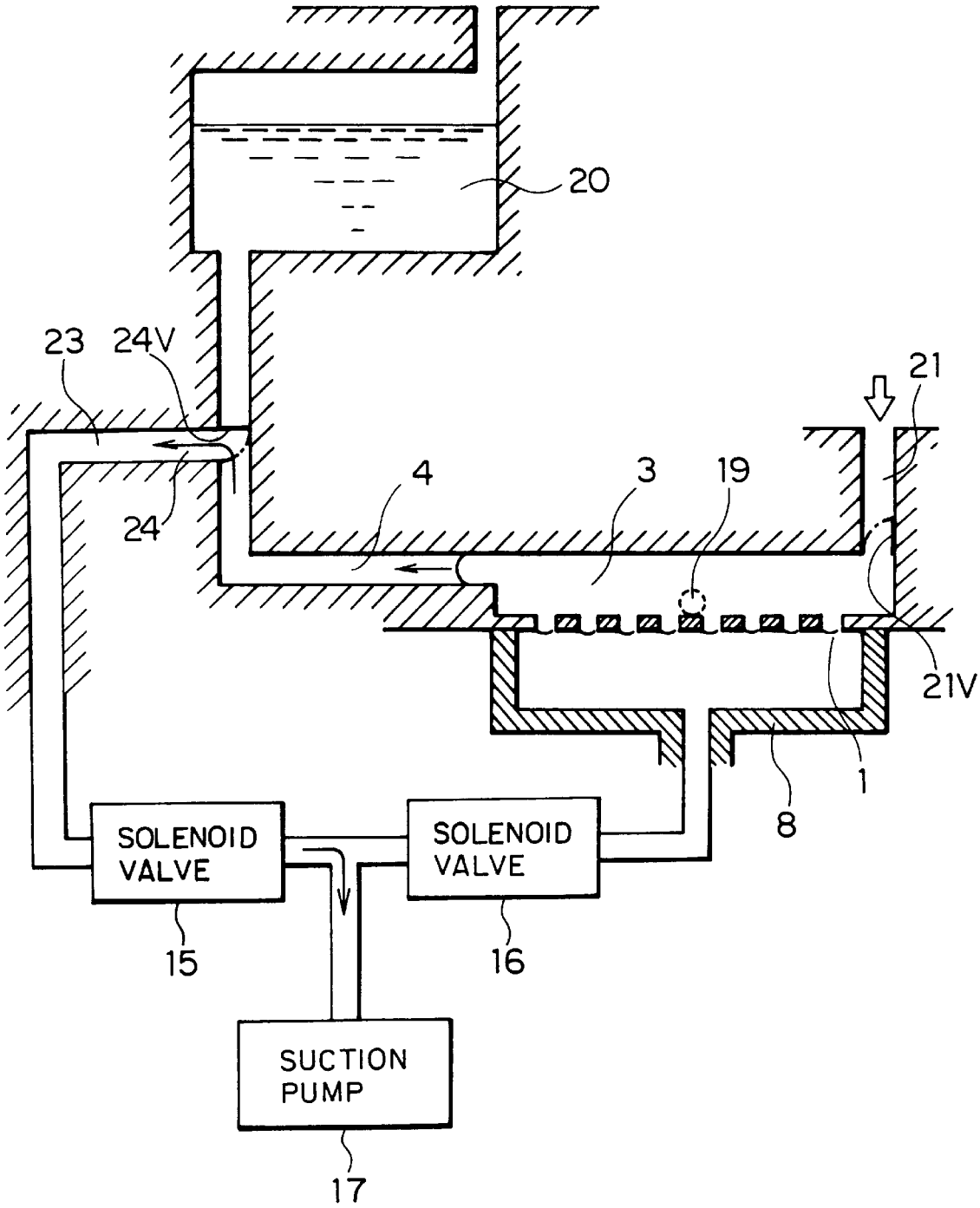
FIG. 2 is a sectional view illustrating sucking operation.

FIG. 1 is a sectional view of the inkjet head and a maintenance mechanism illustrating a state full of ink with bubbles 19 and ordinary ink suction, that is, ordinary sucking operation for removing the bubbles 19. FIG. 2 is a sectional view illustrating the ink sucking operation according to the present invention.

First, the inkjet head is described in the following.

An ink reservoir 3 has a nozzle array 1 where a plurality of nozzles are provided, and is normally filled with ink supplied from an ink tank 20 via an ink supply path 4. The ink reservoir 3 is made in communication with the external via a vent control valve 21V provided for a vent hole 21.

In Embodiment 1, an opening 24 for sucking ink not via the nozzles but directly from the ink reservoir 3 is connected at a halfway point of the ink supply path 4 via a supply control valve 24V for selectively opening and closing the ink supply path 4 and the opening 24. It is to be noted that, however, the present invention is not limited to this particular embodiment, and the supply control valve 24V may be provided in the ink supply path 4 as a valve for opening and closing the ink supply path 4 and the opening 24 may be provided directly at an appropriate place of the ink reservoir 3. In this case, a control valve for opening and closing the opening 24 is not necessarily required to be provided for the opening 24.

It is preferable that the opening 24 and the vent hole 21 are arranged such that ink retreats from the ink reservoir 3 to be absorbed from the opening 24 while maintaining its form as one liquid mass. One preferable example is that the opening 24 is provided on one end side of the ink reservoir 3 while the vent hole 21 is provided on the other end side of the ink reservoir 3.

It is also preferable that the inside of the ink reservoir 3 itself is shaped such that ink can easily retreat (move) while maintaining its form as one liquid mass. One preferable example is that the cross section of the ink reservoir 3 in the direction of movement is made to be small so that surface tension acts effectively.

Further, though the ink tank 20 is illustrated as a mere tank in the figure, it may be an ink cartridge. In the following, the term "an ink tank" shall include an ink cartridge.

It is to be noted that the bubble shown by the numeral 19 in the figure illustrates by way of an example bubbles attached to the vicinity of the base side of the nozzles opening into the ink reservoir 3. The actual size of the bubbles 19 is generally on the order of 100 to 300 $\mu$m.

Next, the maintenance mechanism is described in the following.

A cap portion 8 is provided at a position where it can be detachably attached to the distal end side of the nozzles of the nozzle array 1 and sucks ink via the nozzles from the ink reservoir 3. A solenoid valve 16V is provided at a halfway point of a suction path 16 for opening and closing the suction path 16. The suction path 16 introduces ink sucked by the cap portion 8 toward a suction pump 17.

Next, an ink suction means constructed both in the inkjet head and in the maintenance mechanism is described in the following.

A solenoid valve 15V forming the ink suction means is provided at a halfway point of a suction path 23 for opening and closing the suction path 23. The suction path 23 sucks ink not via the nozzles but directly from the ink reservoir 3 to introduce the ink toward the suction pump 17. The second suction path 23 is connected to the opening 24.

The ink suction means includes, although not shown in the figure, a suction control means for controlling the respective components of the ink suction means such that the suction pump 17 is driven to suck ink in the ink reservoir 3 with the ink supply path 4 being closed by the supply control valve 24v and with the vent control valve 21V being opened to open the vent hole 21.

Since Embodiment 1 is constructed as described in the above, when the bubbles 19 generated in the ink reservoir 3, particularly in the vicinity of the nozzle array 1, are removed, the suction control means receives a signal instructing such, and actuates the suction pump 17 with the ink supply path 4 closed via the supply control valve 24V and with the vent hole 21 for making the ink reservoir 3 in communication with the external opened via the vent control valve 21V, to be able to easily remove the bubbles 19.

When the suction pump 17 is actuated by the ink suction means in this way, ink is sucked through the suction path 23, in the figure, from the ink reservoir 3 through the ink supply path 4 connected with the suction path 23 to the suction path 23. The suction of ink applies negative pressure to the inside of the ink reservoir 3, which introduces the outside air via the vent hole 21 into the ink reservoir 3.

Since ink in the ink reservoir 3 is sucked out to the external via the suction path 23 in this way, while ink retreats from the one side of the ink reservoir 3, the outside air flows into the ink reservoir 3 from the other side to follow the retreating liquid mass of ink with a border between the outside air and the surface of the liquid mass of ink.

During the movement of the border between the surface of the liquid mass of ink and the outside air, ink in the ink reservoir 3 gradually decreases, and thus, an ink layer on the surface of the remaining bubbles 19 which attach to the inside of the ink reservoir 3 becomes gradually thinner, and eventually, only the bubbles 19 are left in the outside air and the bubbles 19 will break.

In this way, the bubbles 19 in the ink reservoir 3 disappear and are removed.

It is to be noted that supplying ink again in the ink reservoir 3 after this ink sucking operation can ensure filling the inkjet head with ink without the bubbles 19.

Next, ordinary ink suction in Embodiment

1is described in the following. The ordinary ink suction is conducted by driving the suction pump 17 to suck ink with the supply control valve 24v being such that the ink reservoir 3 is made to be in communication with the ink tank 20, that is, such that the ink supply path 4 is opened, with the vent control valve 21V of the vent hole 21 being closed, with the solenoid valve 15 being closed, with the solenoid valve 16 being opened, and with the cap portion 8 being in close contact with the nozzle array 1 (in the state shown in FIG. 1).

This operation generates an ink flow in the ink reservoir 3 from the ink supply path 4 via the nozzles of the nozzle array 1 toward the cap portion 8, that is, ink is spit out from the nozzles.

However, though such ink suction is conducted, the bubbles 19 in the ink reservoir 3, particularly those attached to the vicinity of the nozzle array 1, and more particularly, fine such bubbles 19, often remain attaching without being washed away by the ink flow.

This is because the bubbles 19 in liquid is difficult to break, and even they look as if they were broken, actually, the bubbles 19 merely become finer, instead of disappearing. In addition, the finer the bubbles 19 is, the more difficult it becomes to wash them away. Further, when such a bubble or a group of bubbles 19 having strong adhesion against the liquid flow exist, the flow toward where the liquid can easily flow becomes stronger, and thus, on the contrary, the flow toward where the bubbles 19 exist becomes weaker, and the bubbles 19 remain attaching.

It follows that to wash bubbles away with an ink flow has practically little effect with regard to the fine bubbles 19 attaching against the flow. Whether the bubbles 19 have been removed or not can be relatively easily determined with the ordinary ink suction by, for example, printing a test pattern and deciding by visual observation whether the density has become lower or not.

When the result shows that the bubbles 19 have not been removed, the ink suction means according to the present invention may be used as a next tool. This is because, though the ordinary ink suction is not effective with regard to removal of the bubbles 19 as described in the above, since ink is spit out through the nozzles, the ordinary ink suction is effective with regard to nozzles clogged with condensed ink or contamination of foreign matters which occurs relatively frequently.

As described in the above, since Embodiment 1 is constructed such that ink is emptied out of the ink reservoir 3, even the bubbles 19 which affect printing, that is, those sized to be substantially as small as the nozzles, for example, those having a radius of several dozen micrometers, can be made to disappear.

Further, in Embodiment 1, since ink is continuously sucked as one liquid mass from one side toward the other side of the inside of the ink reservoir 3, ink can be removed without fail, and the bubbles 19 can be made to disappear without fail.

It is to be noted that the viscosity and the surface tension of ink are characteristic of the ink to be used, in order to remove ink with more certainty, it is preferable that the ink reservoir 3 is shaped to be thin as shown in the figure and the speed of suction by the suction pump 17 is adjusted such that ink is continuously sucked while maintaining its form as one liquid mass.

Embodiment 2

This Embodiment 2 is another embodiment of claims 1 and 2 of the present invention, and is constructed in the same way as Embodiment 1 to be an inkjet head comprising an ink tank, an ink reservoir having a nozzle array, and an ink supply path for introducing ink from the ink tank into the ink reservoir, further comprising a supply control valve for opening and closing the ink supply path, a vent hole provided with a vent control valve for making the ink reservoir in communication with the external, an ink suction means for sucking ink from the ink reservoir, and a suction control means for making the ink suction means suck ink from the ink reservoir with the supply control valve closed and with the vent control valve open.

Embodiment 2 differs from Embodiment 1 in that, as the ink suction means, that is, the ink suction means for sucking ink from the ink reservoir, a means for ordinary ink suction adopted in a conventional maintenance suction mechanism is adopted.

Embodiment 2 is now described in the following with reference to the drawings.

Figure 3:
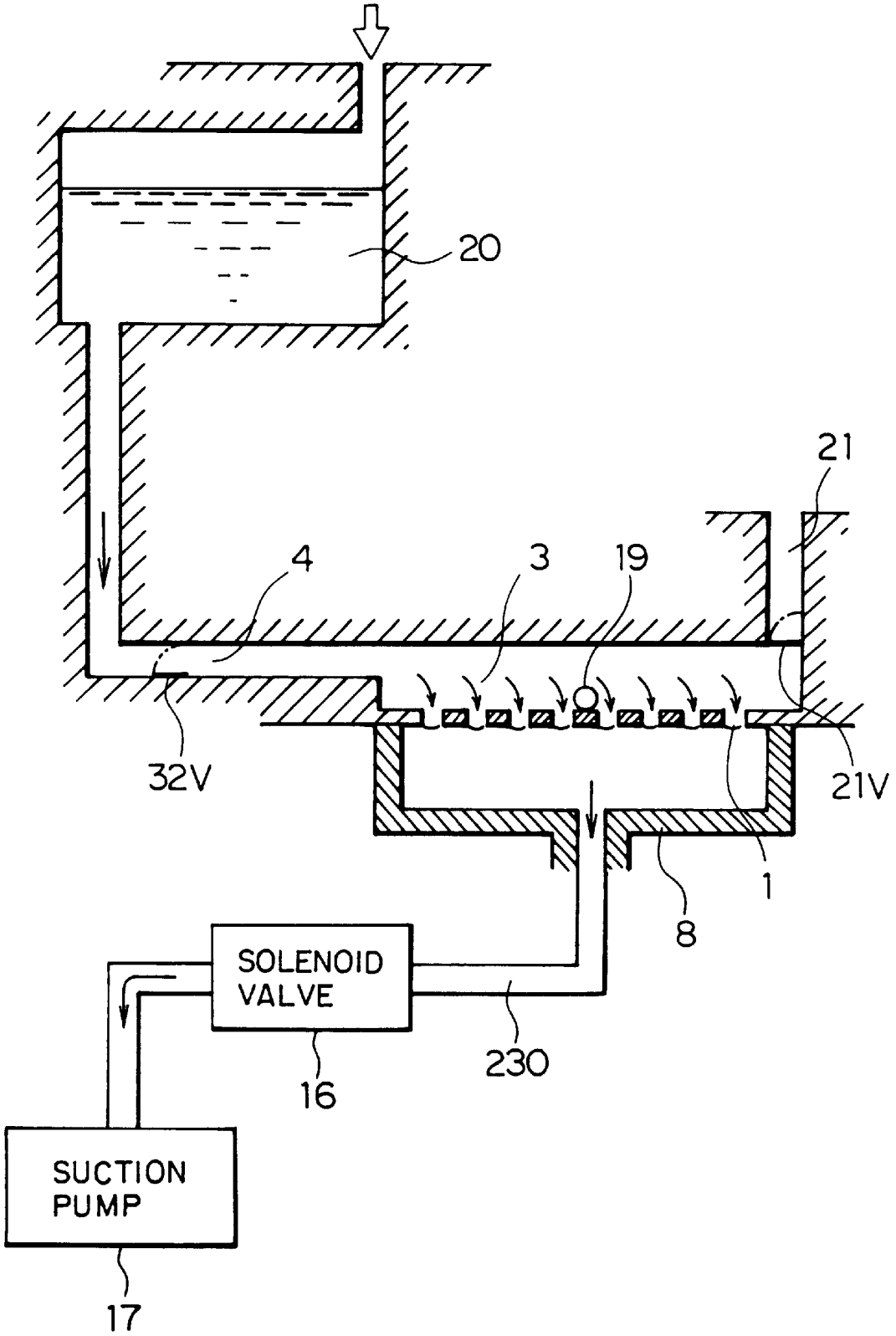
FIG. 3 is a sectional view illustrating Embodiment 2 of the present invention.

FIG. 3 is a sectional view of the inkjet head and a maintenance mechanism illustrating a state full of ink with bubbles 19 and ordinary ink sucking operation for removing the bubbles 19.

First, the inkjet head is described in the following.

An ink reservoir 3 has a nozzle array 1 where a plurality of nozzles are provided, and is filled with ink supplied from an ink tank 20 via an ink supply path 4. The ink reservoir 3 is made in communication with the external via a vent control valve 21V provided for a vent hole 21. The above are the same as in Embodiment 1.

A supply control valve 32V for opening and closing the ink supply path 4 corresponds to the supply control valve 24V in Embodiment 1.

Next, the ink suction means in Embodiment 2 is described in the following.

A cap portion 8 is detachably attached to the distal end side of the nozzles of the nozzle array 1, and sucks ink via the nozzles from the ink reservoir 3. A numeral 16 is a solenoid valve for opening and closing a suction path 230 for introducing ink sucked by the cap portion 8 toward a suction pump 17.

The ink suction means constructed in this way corresponds to the maintenance mechanism in Embodiment 1.

The ink suction means includes, although not shown in the figure, a suction control means for controlling the respective components of the ink suction means such that the suction pump 17 is driven to suck ink in the ink reservoir 3 with the ink supply path 4 being closed by the supply control valve 32V and with the vent control valve 21V being opened to open the vent hole 21.

Since Embodiment 2 is constructed as described in the above, when the bubbles 19 generated in the ink reservoir 3, particularly in the vicinity of the nozzle array 1, are removed, the suction control means receives a signal instructing such, and actuates the suction pump 17 with the ink supply path 4 closed via the supply control valve 32V and with the vent hole 21 for making the ink reservoir 3 in communication with the external opened via the vent control valve 21V.

When the suction pump 17 is actuated by the ink suction means in this way, ink in the ink reservoir 3 is sucked through the nozzles by the cap portion 8 connected with the suction path 230 via the solenoid valve 16V. The suction of ink applies negative pressure to the inside of the ink reservoir 3, which introduces the outside air via the vent hole 21 into the ink reservoir 3.

Since ink in the ink reservoir 3 is sucked out to the external via the suction path 230 in this way, while ink retreats from the one side of the ink reservoir 3, the outside air flows into the ink reservoir 3 from the other side to follow the retreating liquid mass of ink with a border between the outside air and the surface of the liquid mass of ink.

During the movement of the border between the surface of the liquid mass of ink and the outside air, ink in the ink reservoir 3 gradually decreases, and thus, an ink layer on the surface of the remaining bubbles 19 which attach to the inside of the ink reservoir 3 is gradually thinned, and eventually, only the bubbles 19 are left in the outside air, and the bubbles 19 will break.

In case the bubbles 19 still do not break and remain, after ink in the ink reservoir 3 is sucked, the inside of the ink reservoir 3 is further decompressed (is made to be vacuum) by the suction pump 17. By this operation, the bubbles 19 formed by surrounding ink are broken and disappear.

In this case, the sealing member of the vent control valve 22V and the supply control valve 32V is required to withstand the decompression by the suction pump 17. The suction pump 17 is required to have a rated capacity sufficient to decompress the inside of the ink reservoir 3 after sucking ink.

It is to be noted that the description with regard to the further decompression by the suction pump 17 and the pressure tightness of the sealing member is also applied to Embodiment 1.

The construction and action of Embodiment 2 except those described in the above are the same as those of Embodiment 1, and thus, the description thereof is omitted.

Embodiment 3

This Embodiment 3 is an embodiment of claims 3 of the present invention, and is constructed to be an inkjet head comprising an ink tank, an ink reservoir having a nozzle array, and an ink supply path for introducing ink from the ink tank into the ink reservoir, further comprising a tilt means for tilting the inkjet head such that ink filling the ink reservoir flows back toward the ink supply path to retreat at least from the region where the nozzle array is provided in the ink reservoir, and a vent hall provided with a vent control valve for making the ink reservoir in communication with the external such that the retreat of ink is facilitated.

Embodiment 3 is now described in the following with reference to the drawings.

Figure 4:
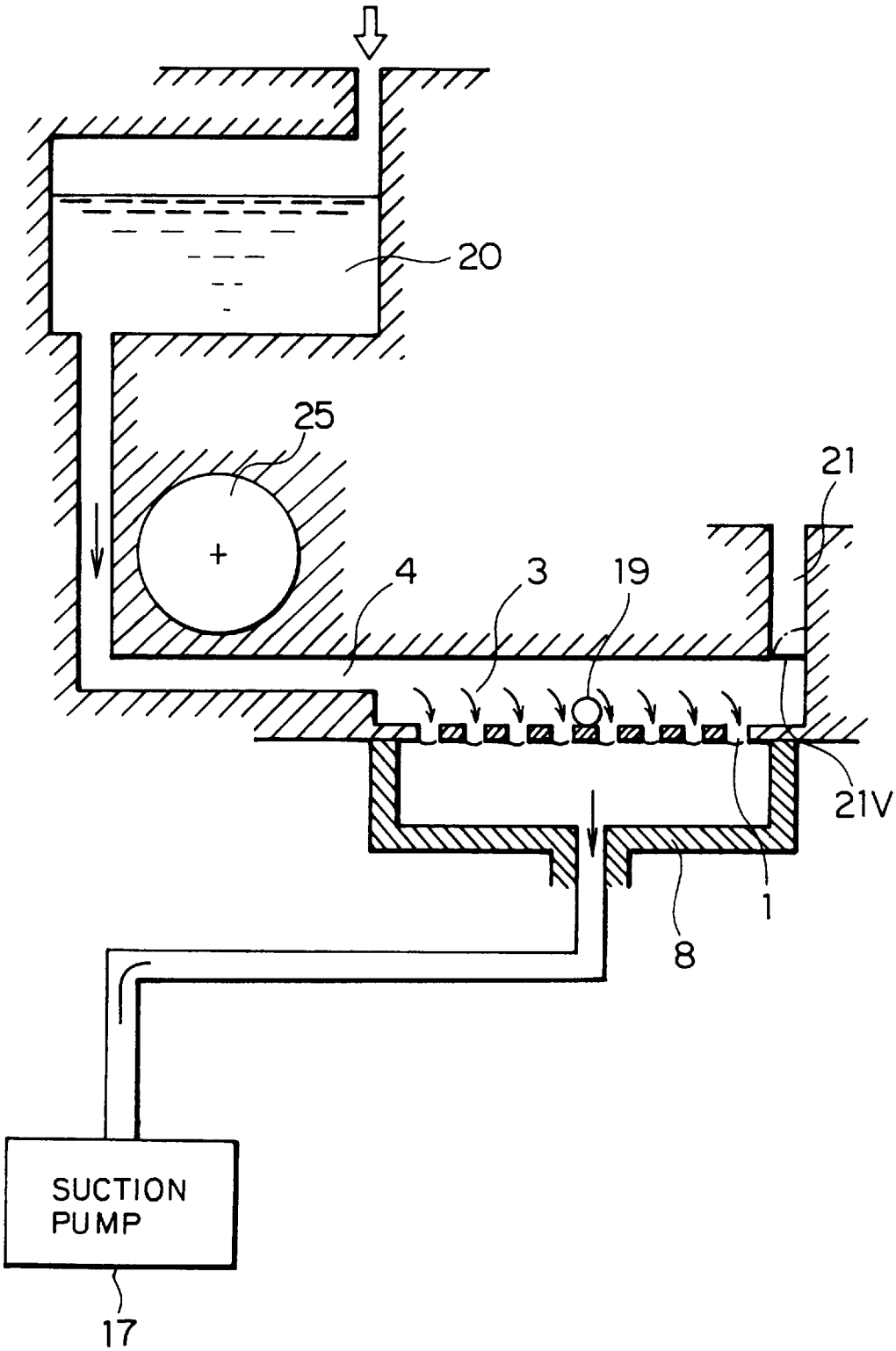
FIG. 4 is a sectional view illustrating Embodiment 3 of the present invention.
Figure 5:
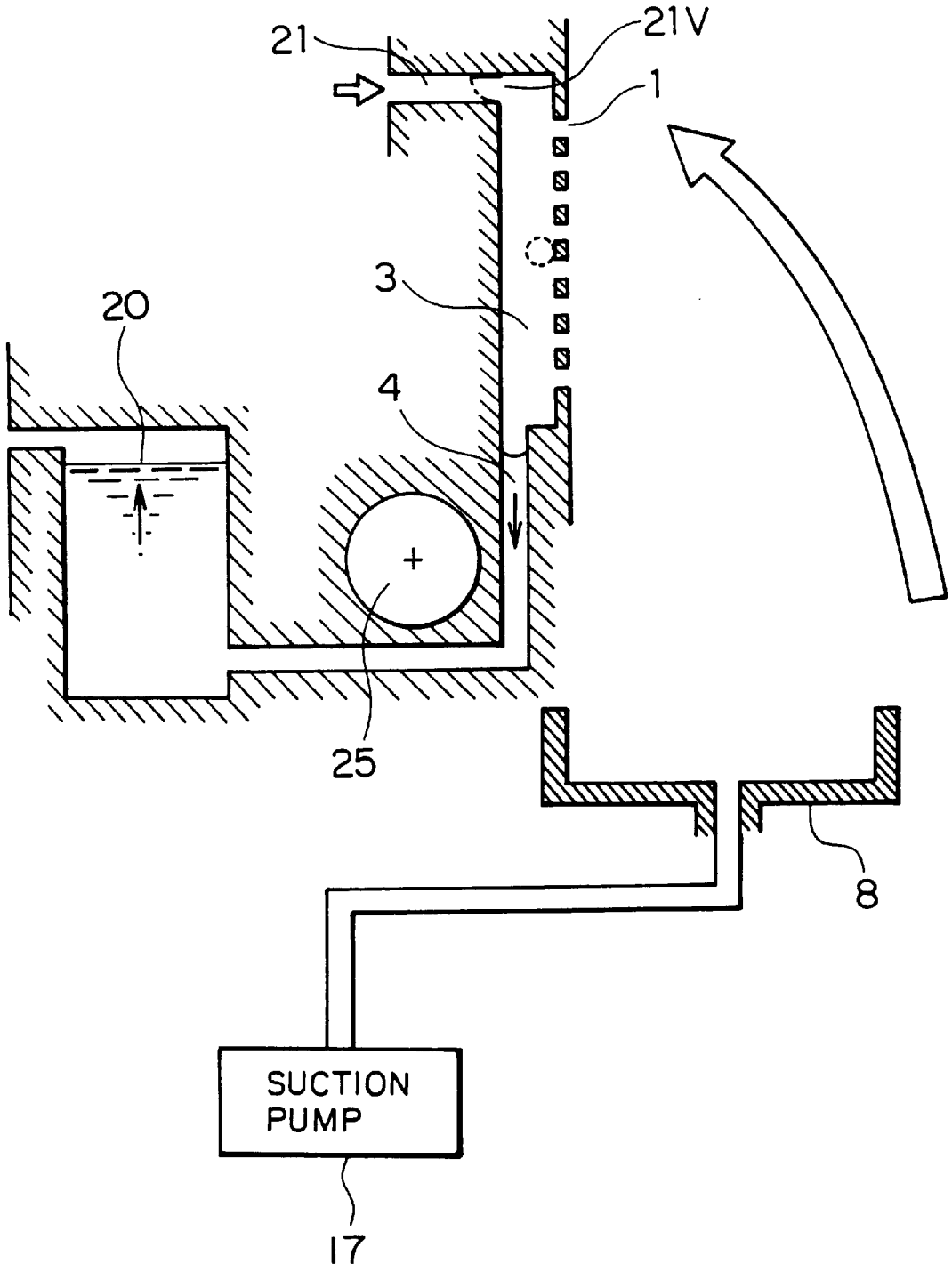
FIG. 5 is a sectional view illustrating a tilted state.
Figure 6:
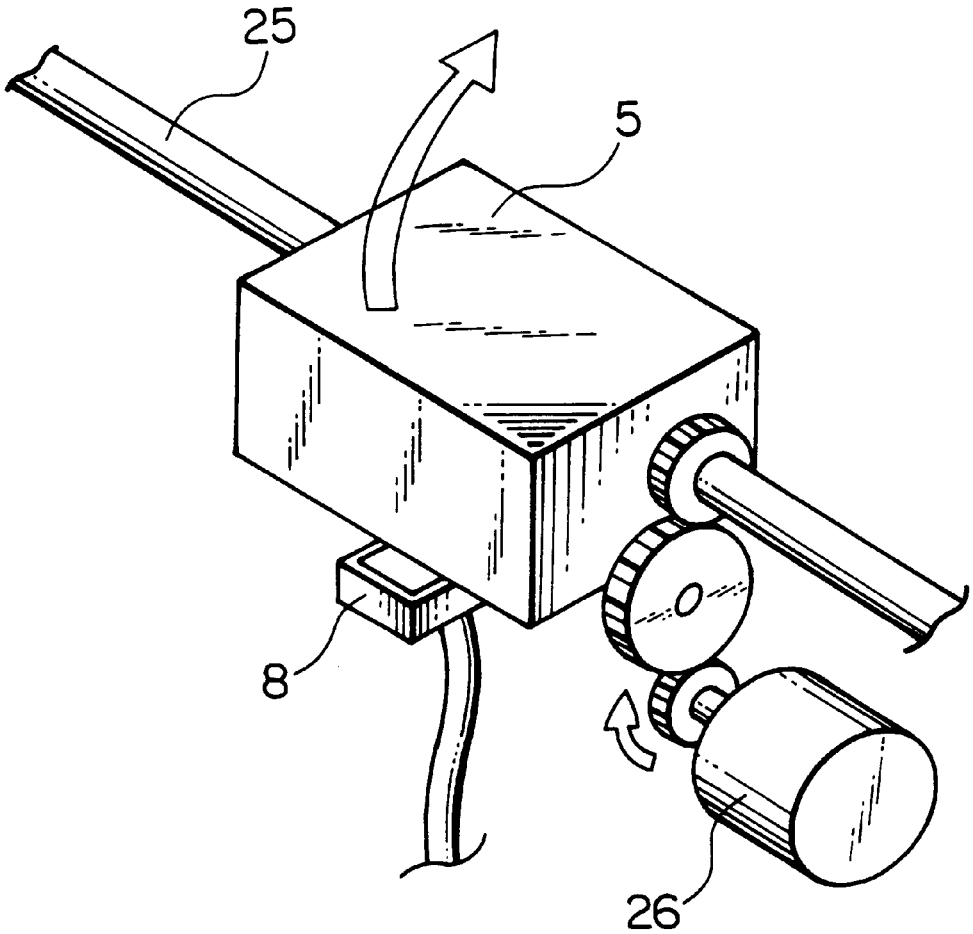
FIG. 6 is a perspective view of a tilting mechanism.
Figure 7:
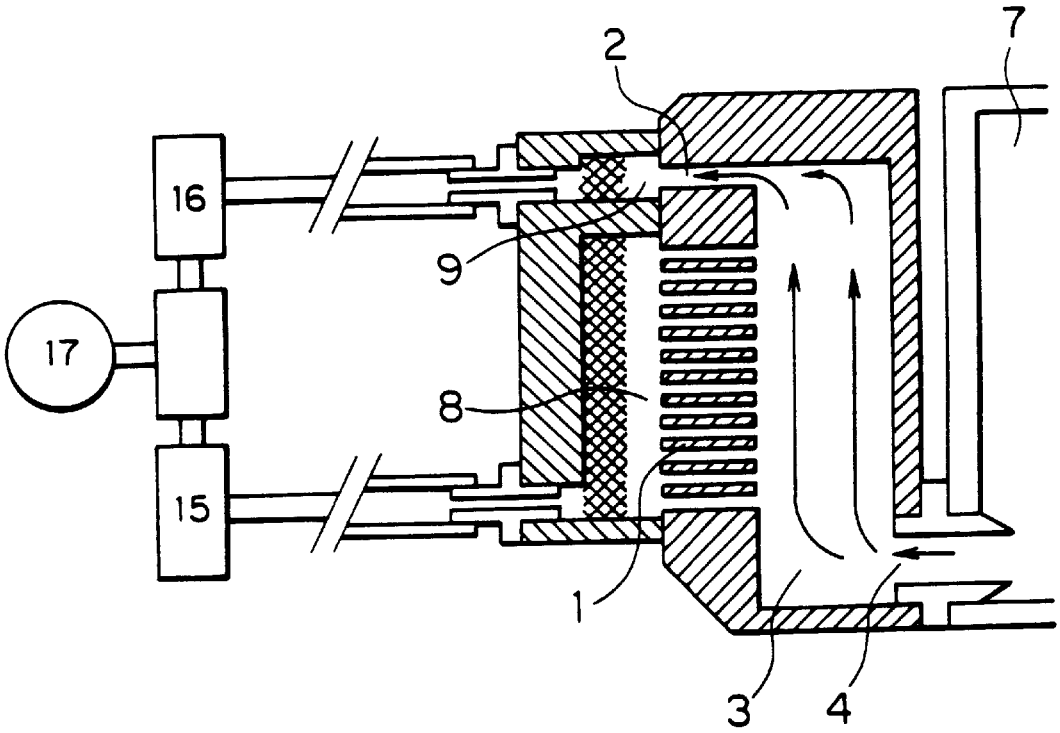
FIG. 7 PRIOR ART
FIG. 7 is a sectional view illustrating a conventional arrangement.

FIG. 4 is a sectional view illustrating a state full of ink with bubbles 19. FIG. 5 is a sectional view illustrating a tilted state. FIG. 6 is a perspective view of an example of the tilting means.

First, the inkjet head is described in the following with reference to FIG. 4.

An ink reservoir 3 has a nozzle array 1 where a plurality of nozzles are provided, and is filled with ink supplied from an ink tank 20 via an ink supply path 4. The ink reservoir 3 is made in communication with the external via a vent control valve 21V provided for a vent hole 21. The above are the same as in Embodiments 1 and 2.

Embodiment 3 differs from Embodiments 1 and 2 in that, it comprises the tilt means for tilting an inkjet head 5.

Embodiment 3 is substantially the same as Embodiment 2 except the above, and thus, like reference characters designate like or corresponding parts and the description thereof is omitted.

Next, The tilt means is described with reference to FIG. 6.

The tilt means is a means for tilting the inkjet head 5 such that ink filling the ink reservoir 3 flows back toward the ink supply path 4 to retreat at least from the region where the nozzle array 1 is provided in the ink reservoir 3 thereby exposing to the outside air the region where the nozzle array 1 is provided. This is because the fine bubbles 19 are liable to be generated in the region where the nozzle array 1 is provided, and in addition, once the fine bubbles 19 have attached, they are difficult to float. Of course, the best way is to completely empty the ink reservoir 3.

As shown in FIG. 5, the tilt means in Embodiment 3 tilts the inkjet head 5 counterclockwise by 90 degrees about a rotational shaft 25 through the inkjet head 5. A driving portion 26 tilts the inkjet head 5.

The rotational shaft 25 in Embodiment 3 is, primarily, a travel guide shaft for guiding the travel of the inkjet head 5 during printing, and is also used as the rotational shaft of the tilt means, thereby attempting to decrease the number of components and to make the construction simpler.

It is to be noted that the tilt means is not limited to the particular one shown in this embodiment, but may be any appropriate conventional arrangement.

In the inkjet head 5 constructed as above, when the bubbles 19 are generated in the vicinity of the nozzles, the ordinary ink suction is conducted as described with regard to Embodiment 2.

In the ordinary ink suction, ink is sucked through the nozzles toward the cap portion 8 by the suction pump 17 with the vent control valve 21V being closed. This operation generates an ink flow in the ink reservoir 3 from the ink supply path 4 toward the nozzles, and removal of the bubbles 19 is attempted.

In case the bubbles 19 generated in the vicinity of the nozzles can not be removed by this ordinary ink suction, that is, in case the bubbles 19 attach where no ink flow is generated by the ordinary ink suction or in case the bubbles 19 attach firmly, it is quite effective to apply the present invention to completely empty ink out of the ink reservoir 3 thereby making the bubbles 19 in contact with the outside air to break the bubbles 19.

More specifically, with the vent control valve 21V open, the inkjet head 5 is rotated at a predetermined speed about the rotational shaft 25 by rotational driving of the rotational driving portion 26 to be stopped at a predetermined angle as shown in, for example, FIG. 6.

By this operation, beginning on the side of the ink supply path 4, ink in the ink reservoir 3 is moved continuously into the ink tank 20. According to the retreat of the ink, the outside air the quantity of which corresponds to that of the ink which retreats flows into the ink reservoir 3 from the side of the vent hole 21.

According to the tilt, ink continuously retreats (moves) from the one side to the other side of the ink reservoir 3, and eventually, the ink reservoir 3 is emptied with no ink remaining.

In this way, when ink inside the ink reservoir 3 is completely removed, the bubbles 19 formed by an ink film is broken by the outside air to completely disappear.

After that, with the vent control valve 21V closed, the inkjet head 5 is rotated in the reverse direction at a predetermined speed from the tilted state to return to the initial state. After the inkjet head 5 is stopped, the cap portion 8 is made to be in contact with the inkjet head 5. By sucking air inside the ink reservoir 3 from the nozzles via the cap portion 8 using the suction pump 17, the ink reservoir 3 is filled with ink.

It is to be noted that, though it is described that, in case the bubbles 19 are generated in the vicinity of the nozzles, ink is sucked from the cap portion 8 first as the ordinary ink suction, the ordinary ink suction may be omitted and the ink reservoir 3 may be emptied to apply the present invention attempting removal of the bubbles 19.

Since the present invention is constructed as described in the above, the present invention has the following effects.

According to Embodiments 1 to 3 of the present invention, since bubbles which can not be removed by a conventional ink flow method are broken and removed without wasting ink, a bubble remover for an inkjet head and a method for removing bubbles thereof with which fine bubbles which are conventionally difficult to remove can be removed without fail can be provided.

Further, even bubbles which are generated or moved where no ink flow is generated by the ordinary ink sucking operation, bubbles which attach so firmly that it is difficult to float them using an ink flow, and so on can be easily removed.

Accordingly, a state full of ink with no bubbles at all can also be accomplished by filling ink again.

In addition, this makes it possible to ensure stable operation without malfunction of spitting ink from the nozzles and without dispersion in spitting.

Still further, waste of ink in relation to removal of bubbles can be made minimum.

In particular, according to claim 3 of the present invention, since bubbles can be removed only by tilting the inkjet head and moving ink out of the ink reservoir, there is completely no waste of ink in relation to removal of bubbles, which is quite economical.

What is claimed is:

1. A bubble removing system for an inkjet head comprising:

an ink tank;

an ink reservoir having a nozzle array;

an ink supply path for introducing ink from said ink tank into said ink reservoir;

a supply control valve for opening and closing said ink supply path; and a vent hole provided with a vent control valve which, when opened, communicates said ink reservoir with outside air;

an ink suction means for drawing ink from said ink reservoir; and a suction control means for causing said ink suction means to operate with said supply control valve closed and with said vent control valve open.

2. An apparatus according to claim 1, further comprising a tilt means for tilting the inkjet head to allow ink to retreat at least from the region where said nozzle array is located within said ink reservoir.

3. A method for removing bubbles within an inkjet head comprising an ink tank, an ink reservoir having a nozzle array, and an ink supply path for introducing ink from said ink tank into said ink reservoir, said method comprising:

drawing said ink from said ink reservoir, while introducing air into said ink reservoir via a vent hole, said vent hole communicating said ink reservoir with outside air; wherein negative pressure applied to said ink reservoir in said drawing step is maintained while keeping said ink supply path closed and said vent hole open.

4. A method for removing bubbles within an inkjet head comprising an ink tank, an ink reservoir having a nozzle array, and an ink supply path for introducing ink from said ink tank into said ink reservoir, said method comprising:

tilting said inkjet head such that ink filling said ink reservoir flows back toward said ink supply path to retreat at least from the region where said nozzle array is located within said ink reservoir; and opening a vent hole controlled by a vent control valve for communicating said ink reservoir with outside air such that the retreat of ink is facilitated.

5. An inkjet head comprising:

an ink tank;

an ink reservoir having a nozzle array;

an ink supply path for introducing ink from said ink tank into said ink reservoir;

a supply control valve which opens and closes said ink supply path;

a vent control valve having a vent hole which, when opened, communicates with outside air; and a suction pump which communicates with said inkjet head, wherein said suction pump is designed to draw ink from said ink reservoir, and said suction pump is responsive to a controller which causes said suction pump to operate with said supply control valve closed and with said vent control valve open.

6. An apparatus according to claim 5, further comprising a tilting means which tilts the inkjet head to allow ink to retreat, at least from the region where said nozzle array is located within the ink reservoir.

* * * * *